US006840813B2

(12) United States Patent
Kim

(10) Patent No.: US 6,840,813 B2
(45) Date of Patent: Jan. 11, 2005

(54) CONNECTING APPARATUS FOR THREE PHASE INDUCTION MOTOR OF ELECTRIC VEHICLE

(75) Inventor: Tae Woo Kim, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/747,008

(22) Filed: Dec. 23, 2003

(65) Prior Publication Data

US 2004/0253876 A1 Dec. 16, 2004

(30) Foreign Application Priority Data

Jun. 16, 2003 (KR) ..... 10-2003-0038802

(51) Int. Cl.[7] ..... H01R 25/00

(52) U.S. Cl. ..... 439/651; 439/721; 439/189; 439/956

(58) Field of Search ..... 439/651–655, 439/721, 723, 724, 956, 189, 105

(56) References Cited

U.S. PATENT DOCUMENTS 3,525,971 A * 8/1970 Glassman ..... 439/105
3,626,354 A * 12/1971 Banner ..... 439/105
3,938,068 A * 2/1976 Hagan ..... 337/189
4,053,788 A * 10/1977 Robie ..... 307/11
4,173,383 A * 11/1979 Lee ..... 439/105
4,386,333 A * 5/1983 Dillan ..... 336/107
4,911,649 A * 3/1990 Helmich, Jr. ..... 439/170
5,474,464 A * 12/1995 Drewnicki ..... 439/172
6,771,775 B1 * 8/2004 Widmer ..... 379/413.04

FOREIGN PATENT DOCUMENTS

JP 04-334908 11/1992

* cited by examiner

*Primary Examiner*—Ross Gushi
(74) *Attorney, Agent, or Firm*—Morgan Lewis & Bockius LLP

(57) ABSTRACT

A connecting apparatus for constituting a Y-connection of three phase windings of a three phase induction motor or supplying three phase power to the three phase windings includes a first connector and a second connector. The first connector has three terminals respectively extending from the three phase windings. The second connector has a Y-connection plug, which is coupled to the first connector and constitutes a Y-connection of the three terminals. The second connector also has slots for guiding a plug for supplying three phase power to the three terminals of the first connector. Accordingly, it is not required to separate the second connector from the first connector for supplying three phase power to the three phase windings of the induction motor.

4 Claims, 4 Drawing Sheets

CONNECTING APPARATUS FOR THREE PHASE INDUCTION MOTOR OF ELECTRIC VEHICLE

CROSS-REFERENCE TO RELATED APPLICATIONS

This application claims priority of Korean Application No. 10-2003-0038802, filed on Jun. 16, 2003, the disclosure of which is incorporated fully herein by reference.

FIELD OF THE INVENTION

The present invention relates to a connecting apparatus for a three phase induction motor, and more particularly to a connecting apparatus for constituting a Y-connection of three terminals which are respectively connected to three phase windings of the three phase induction motor or for supplying three phase electric power to the three terminals for charging a battery.

BACKGROUND OF THE INVENTION

Generally, in order to constitute a Y-connection for three terminals or alternatively supply three phase electric power to the three terminals, two kinds of connectors are required. A connector having a Y-connection is connected to the three terminals, or a connector connected to the three phase power source is coupled thereto after removing the connector having a Y-connection from the three terminals.

SUMMARY OF THE INVENTION

An exemplary connecting apparatus for constituting a Y-connection of three phase windings of a three phase induction motor or supplying three phase power to three phase windings comprises a first connector having three terminals which are respectively coupled to the three phase windings and a second connector having a Y-connection plug. The second connection is coupled to the first connector and constitutes a Y-connection of the three terminals, and slots for guiding a plug for supplying the three phase power to the three terminals of the first connector.

Preferably, a plug-receiving portion is formed on one side of the first connector, and the plug-receiving portion is divided into a conductive portion electrically connected to the three terminals, and a non-conductive portion electrically insulated from the three terminals.

Preferably, in the case that the Y-connection of the three terminals is required, the Y-connection plug of the second connector is received into the conductive portion of the receiving portion formed on the first connector.

Preferably, in the case that supplying three phase power to the three terminals is required, the Y-connection plug of the second connector is received into the non-conductive portion of the receiving portion formed on the first connector, and the plug for supplying the three phase power is guided by the slots of the second connector to be received into the conductive portion of the receiving portion formed on the first connector.

Embodiments of the present invention thus provide the non-limiting advantage of preventing repeated replacement of the connector which is selected based on the required connection of the three terminals.

DETAILED DESCRIPTION OF THE PREFERRED EMBODIMENTS

Preferred embodiments of the present invention will hereinafter be described in detail with reference to the accompanying drawings.

Figure 1:
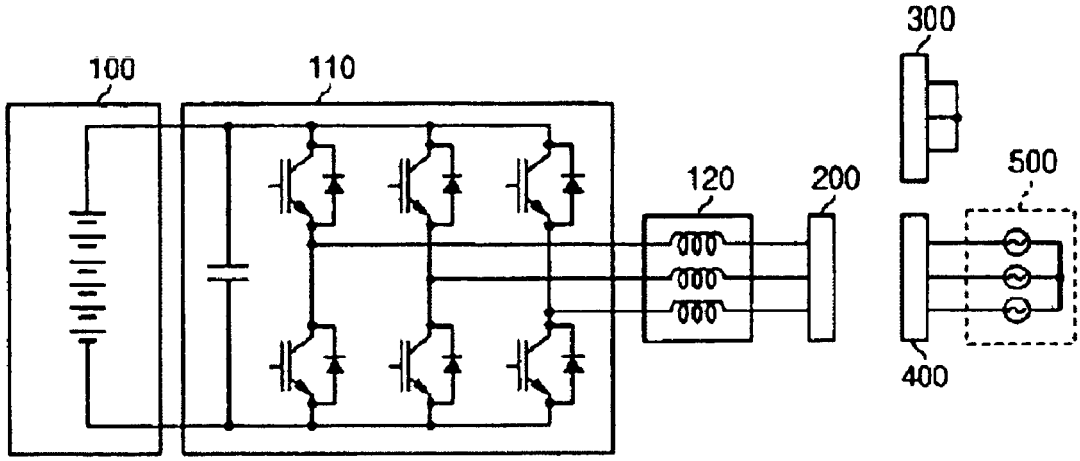
FIG. 1 is a block diagram of a driving/recharging system of an electric vehicle according to an embodiment of this invention.

As shown in FIG. 1, a driving/recharging system of an electric vehicle includes a battery 100 supplying DC power, a three phase induction motor 120, an inverter 110 interconnected between the battery 100 and the three phase induction motor 120 for converting DC to AC and AC to DC, and a first connector 200 having three terminals respectively connected to three phase windings of the three phase induction motor 120.

When the three phase induction motor is driven, DC power from the battery 100 is converted to AC power by the inverter 110, and gate signals generated based on PWM (Pulse Width Modulation) are applied to the inverter 110 so that the three phase induction motor is driven. Accordingly, the three terminals of the first connector 200 should constitute a Y-connection, so the first connector 200 is connected to a second connector 300, which has a Y-connection, and the three phase motor 120 can be driven utilizing the AC power from the inverter 110.

Meanwhile, when the battery is recharged by the three phase AC power source 500, the first connector 200 should be connected to a three phase power supply connector 400.

The three phase AC power source 500 supplies power to the inverter 110 through the three terminals of the first connector 200 and the three phase windings of the three phase induction motor 120, such that the three phase AC power is converted to DC power by the inverter 110 when gate signals generated based on PWM (Pulse Width Modulation) are applied to the inverter 110 so that the battery 100 is recharged.

Figure 2A:
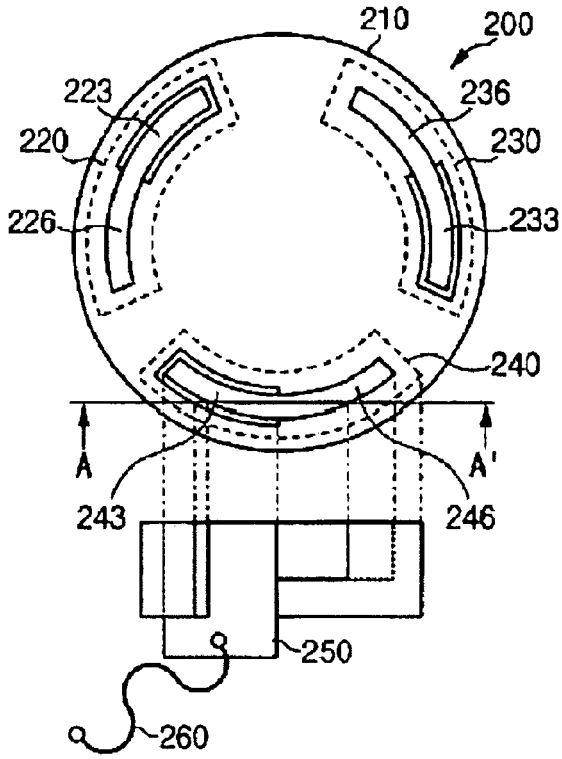
FIG. 2*a* illustrates a first connector of a connecting apparatus for a three phase induction motor of the electric vehicle according to an embodiment of the present invention.

FIG. 2*a* illustrates a first connector of a connecting apparatus for a three phase induction motor of the electric vehicle according to an embodiment of this invention. As shown in FIG. 2*a*, the first connector 200 includes a cylindrical first connector body 210, formed with non-conductive materials, preferably plastic. Receiving portions 220, 230, 240 are respectively connected to three terminals 250 which are respectively connected to the three phase windings of the three phase induction motor 120 through expansion cables 260.

The three terminals 250 are fixed onto one side of the first connector body 210, and the receiving portions 220, 230, 240 are formed on the other side of the first connector body 210 and longitudinally extend into the first connector body 210. Furthermore, the receiving portions 220, 230, 240 are formed following the circular contour of the first connector body 210, with a predetermined diameter. Each receiving portion 220, 230, 240 is divided into two portions, of which one portion is a conductive portion 223, 233, 243 electrically connected to the each of the three terminals 250, the other of which is a non-conductive portion 226, 236, 246 electrically insulated from the three terminals 250.

Figure 2B:
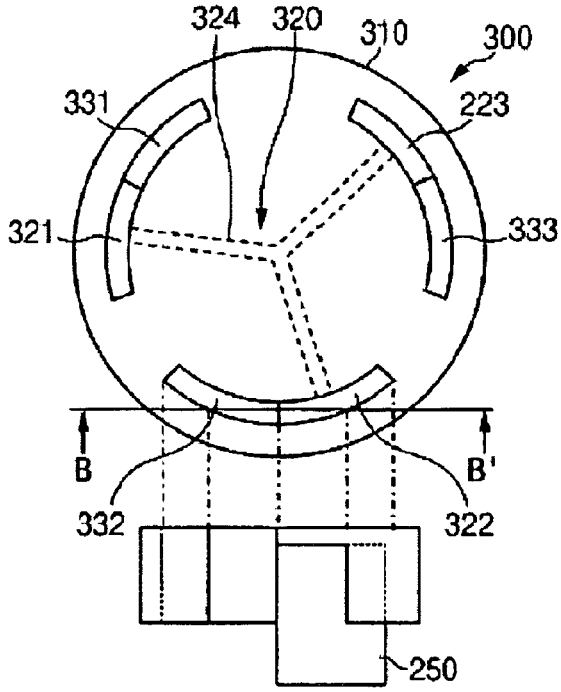
FIG. 2*b* illustrates a second connector of a connecting apparatus for a three phase induction motor of the electric vehicle according to an embodiment of this invention.

FIG. 2*b* illustrates a second connector of a connecting apparatus for the three phase induction motor of the electric vehicle according to an embodiment of this invention. As shown in FIG. 2*b*, the second connector 300 has a cylindrical second connector body 310, a Y-connection plug 320, and slots 331, 332, 333 for guiding a plug supplying three phase power to the three terminals of the first connector 210. The Y-connection plug 320 includes plug pins 321, 322, 323 that are received into the respective receiving portions 220, 230, 240, and a Y-connection circuit 324 that connects the plug pins 321, 322, 323 and is molded into the second connector body 310. Preferably, the second connector body 310 is formed with non-conductive materials, preferably plastic.

The Y-connection plug pins 321, 322, 323 are respectively inserted into the receiving portions 220, 230, 240 and can be rotated within a predetermined range between the conductive portions 223, 233, 243 and non-conductive portions 226, 236, 246. The slots 331, 332, 333 of the second connector 300 are formed in accordance with a circular contour mirroring that of the receiving portions 220, 230, 240 of the first connector body 210, and they longitudinally extend through the second connector body 320.

Figure 3A:
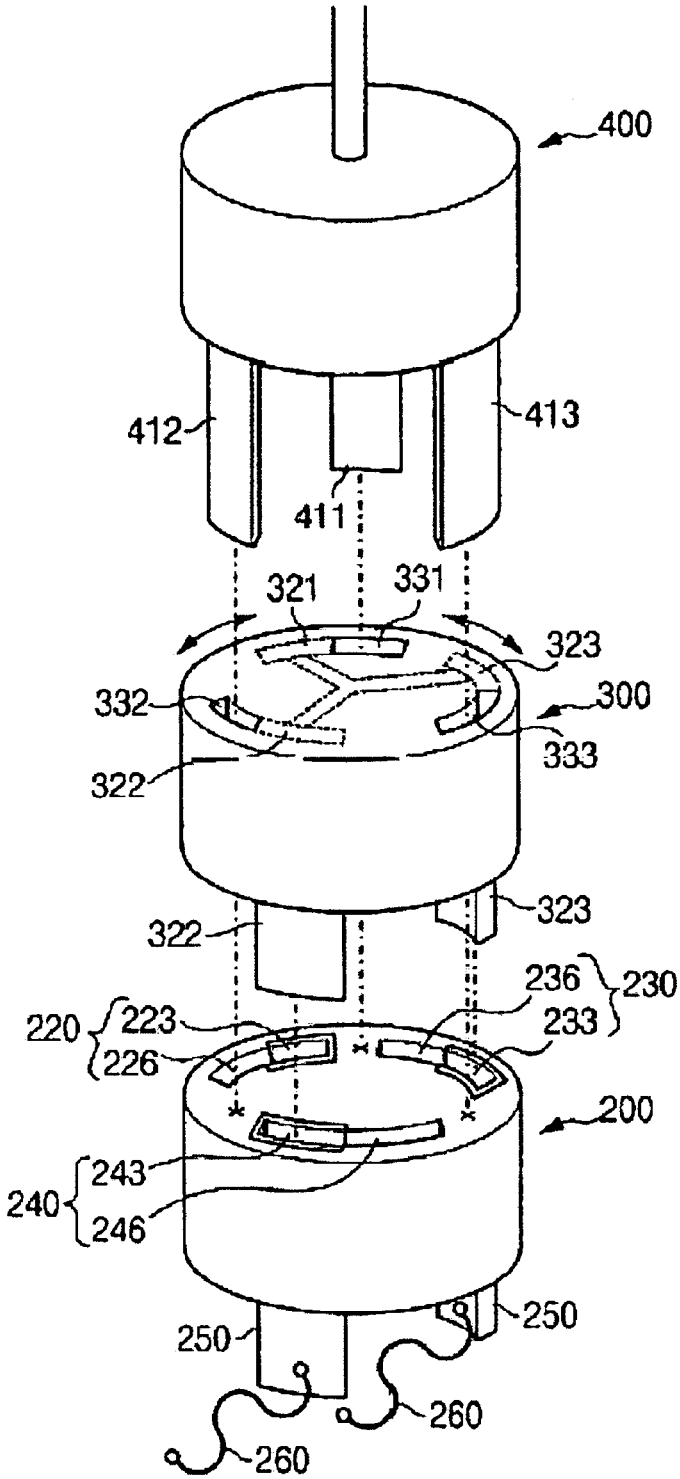
FIG. 3*a* is an assembly diagram of the first connector and the second connector for the case that the Y-connection is required, according to one embodiment of the present invention.

FIG. 3*a* is an assembly diagram of the first connector 200 and the second connector 300 for the case that the Y-connection is required. The Y-connection plug pins 321, 322, 323 are respectively received into the conductive portions 223, 233, 243 of the receiving portions 220, 230, 240 formed on the first connector 200.

The three terminals 250, which are respectively coupled to the three phase windings by the expansion cables 260, can constitute a Y-connection utilizing the conductive portions 223, 233, 243, the plug pins 321, 322, 323, and the Y-connection circuit 324. When the Y-connection is constituted so that the three phase induction motor 120 may be driven, plug pins 411, 412, 413 of a plug 400 for supplying external three phase power can not be connected to the receiving portions 220, 230, 240 of the first connector 200 even when the plug pins 411, 412, 413 are guided by the slots 331, 332, 333 of the second connector 300. Accordingly, three phase power can not be supplied to the battery 100 when the three phase induction motor 120 is in a position to be driven.

Figure 3B:
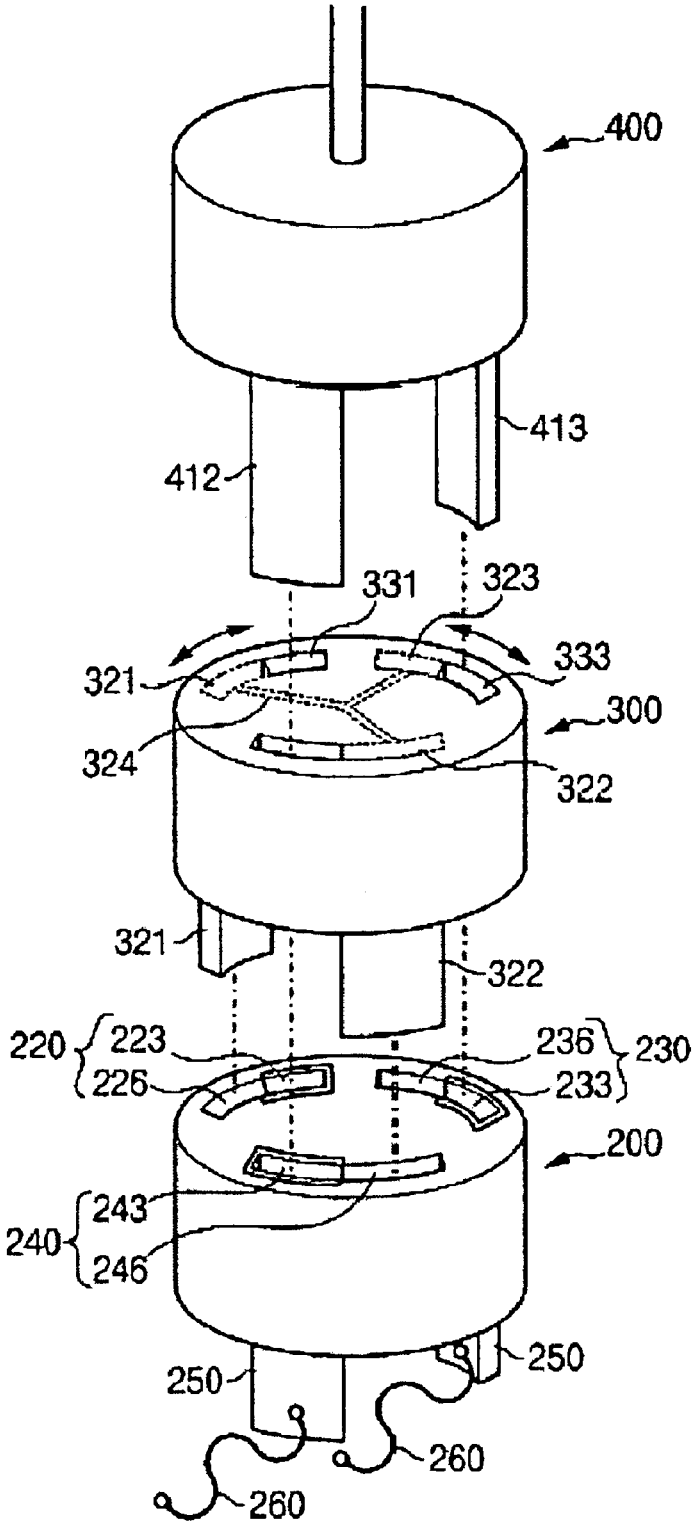
FIG. 3*b* is an assembly diagram of the first connector and the second connector for the case that supplying the three phase power source is required, according to another embodiment of the present invention.

FIG. 3*b* is an assembly diagram of the first connector and the second connector for the case that supplying three phase power is required. When the Y-connection plug pins 321, 322, 323 are respectively connected to the conductive portions 223, 233, 243 of the receiving portions 220, 230, 240 in the first connector 200, if the second connector 300 is rotated with respect to the first connector 200, the Y-connection plug pins 321, 322, 323 are separated from the conductive portions 223, 233, 243 and are shifted to the non-conductive portions 226, 236, 246. Then, the slots 331, 332, 333 for guiding the plug 400 of the second connector 300, respectively communicate with the conductive portions 223, 233, 243 of the first connector 200. Accordingly, if the plug pins 411, 412, 413 of the plug 400 are inserted into the slots 331, 332, 333, the plug pins are guided by the slots and respectively connected to the conductive portions 223, 233, 243.

According to the above-described embodiments of the present invention, it is not required to separate the second connector from the first connector for supplying three phase power to the three phase windings of the induction motor.

Furthermore, when the plug for supplying three phase power is connected to the first connector, the second connector is completely insulated from both the first connector and the plug for supplying three phase power, so that safety is guaranteed.

What is claimed is:

1. A connecting apparatus for constituting a Y-connection to three phase windings of a three phase induction motor or supplying three phase power to the three phase windings, comprising:

a first connector having three terminals respectively coupled to the three phase windings;

a second connector having a Y-connection plug coupled to the first connector and forming a Y-connection of three terminals, and having slots for guiding a plug to supply three phase power to the three terminals of the first connector.

2. The apparatus of claim 1, wherein a plug-receiving portion is formed on one side of the first connector, and the plug-receiving portion is divided into a conductive portion electrically connected to the three terminals and a non-conductive portion electrically insulated from the three terminals.

3. The apparatus of claim 2, wherein, when the Y-connection of the three terminals is required, the Y-connection plug of the second connector is received into the conductive portion of the receiving portion formed on the first connector.

4. The apparatus of claim 2, wherein, when supplying three phase power to the three terminals is required, the Y-connection plug of the second connector is received into the non-conductive portion of the receiving portion formed on the first connector, and the plug for supplying three phase power is guided by the slots of the second connector and received into the conductive portion of the receiving portion formed on the first connector.

* * * * *